US012521602B2

(12) United States Patent
Colley

(10) Patent No.: US 12,521,602 B2
(45) Date of Patent: Jan. 13, 2026

(54) PHYSICAL THERAPY TREADMILL AND TREADMILL ACCESSORY

(71) Applicant: George L. Colley, Detroit, MI (US)

(72) Inventor: George L. Colley, Detroit, MI (US)

( * ) Notice: Subject to any disclaimer, the term of this patent is extended or adjusted under 35 U.S.C. 154(b) by 109 days.

(21) Appl. No.: 18/630,258

(22) Filed: Apr. 9, 2024

(65) Prior Publication Data

US 2025/0312646 A1 Oct. 9, 2025

(51) Int. Cl.

| | |
|---|---|
| ***A63B 22/02*** | (2006.01) |
| ***A47C 3/24*** | (2006.01) |
| ***A63B 21/00*** | (2006.01) |
| ***A63B 22/00*** | (2006.01) |

(52) U.S. Cl.

CPC ..... *A63B 22/02* (2013.01); *A47C 3/24* (2013.01); *A63B 21/4034* (2015.10); *A63B 21/4035* (2015.10); *A63B 2022/0094* (2013.01); *A63B 2208/0233* (2013.01)

(58) Field of Classification Search

CPC ... A47C 3/24; A63B 21/4027; A63B 21/4034; A63B 21/4035; A63B 22/02; A63B 2022/0094; A63B 71/0009; A63B 2071/0018; A63B 2208/0233

See application file for complete search history.

(56) References Cited

U.S. PATENT DOCUMENTS

| | | | | |
|---|---|---|---|---|
| 5,437,588 | A * | 8/1995 | Abboudi | A63B 22/02 482/54 |
| 7,892,150 | B1 * | 2/2011 | Colley | A63B 22/0235 482/54 |
| 9,498,696 | B1 * | 11/2016 | Razon | A63B 22/0046 |
| 10,376,734 | B1 * | 8/2019 | Razon | A61B 5/0077 |
| 12,376,674 | B1 * | 8/2025 | Johnson | A47B 39/023 |
| 2004/0248699 | A1 * | 12/2004 | Colley | A63B 22/02 482/54 |
| 2012/0264573 | A1 * | 10/2012 | Hsu | A63B 22/0235 482/54 |
| 2013/0116092 | A1 * | 5/2013 | Martinez | A63B 24/0062 482/9 |
| 2014/0100085 | A1 * | 4/2014 | Hao | A63B 22/0015 482/54 |
| 2015/0099614 | A1 * | 4/2015 | Tekulve | A61H 3/04 482/139 |
| 2015/0251047 | A1 * | 9/2015 | Maaniitty | A47B 9/20 482/54 |
| 2015/0351553 | A1 * | 12/2015 | Herring | A47C 7/006 108/50.11 |

(Continued)

FOREIGN PATENT DOCUMENTS

| | | | | |
|---|---|---|---|---|
| CN | 107913492 | A * | 4/2018 | A63B 23/04 |
| EP | 0002188 | A1 * | 6/1979 | A63B 69/0057 |

(Continued)

*Primary Examiner* — Gary D Urbiel Goldner

(74) *Attorney, Agent, or Firm* — Gunther J. Evanina; BUTZEL LONG

(57) ABSTRACT

Treadmills and treadmill accessories for allowing physically impaired individuals to exercise and engage in therapeutic rehabilitating activities without the need for assistance from other individuals include a seat integrated into the treadmill or accessory to allow the physically impaired individual to exercise on a treadmill from a seated position or to step onto a running deck of a treadmill from a seated position.

13 Claims, 9 Drawing Sheets

(56) References Cited

U.S. PATENT DOCUMENTS

| | | | | |
|---|---|---|---|---|
| 2016/0166451 | A1* | 6/2016 | Tekulve | A61G 7/1046<br>297/5 |
| 2017/0252602 | A1* | 9/2017 | Lefkovitz | A63B 69/0064 |
| 2021/0046354 | A1* | 2/2021 | Oaks | A47B 83/001 |

FOREIGN PATENT DOCUMENTS

| | | | | | |
|---|---|---|---|---|---|
| EP | 3578085 | A1 | * | 12/2019 | A47B 9/20 |
| KR | 20180014794 | A | * | 2/2018 | A47C 7/60 |
| KR | 20190035553 | A | * | 4/2019 | A63B 22/02 |
| KR | 20220127650 | A | * | 9/2022 | A63B 22/025 |
| WO | WO-2004110566 | A1 | * | 12/2004 | A63B 22/02 |

* cited by examiner

PHYSICAL THERAPY TREADMILL AND TREADMILL ACCESSORY

FIELD OF THE DISCLOSURE

This disclosure pertains generally to physical therapy apparatus, and more particularly to apparatus for strengthening and improving movement of weakened lower body muscles.

BACKGROUND OF THE DISCLOSURE

My U.S. Pat. No. 7,892,150 describes a combined treadmill and seat assembly useful for assisting a physically impaired user to exercise without the assistance of a caregiver. More affluent individuals in need of physical rehabilitation, or those anticipating long-term physical therapy can benefit from having this apparatus in their home. However, the apparatus described in U.S. Pat. No. 7,892,150 may be better suited for a rehabilitation center.

Those individuals in need of strengthening leg and other lower body muscles, such as to fully rehabilitate lower body movement and strength after an injury, may prefer a simpler and less expensive alternative that can be comfortably and conveniently used in the privacy of their home, such as an accessary for use with conventional home fitness equipment.

SUMMARY OF THE DISCLOSURE

Disclosed are treadmills and treadmill accessories for allowing physically impaired individuals to safely use a treadmill for exercise or rehabilitation without requiring assistance from another individual.

The disclosed accessories allows a typical treadmill to be easily and inexpensively converted for use as a physical therapy apparatus to help physically impaired individuals exercise and build greater strength, flexibility, mobility and balance.

The accessory can include a base comprised of side members and a rear member that are joined to form a rigid base to support handrails along the length of the running deck of a treadmill and facilitate mounting of a seat at the rear end of the treadmill. These features allow a physically impaired individual to use the handrails to raise themselves from a seated position to a standing position on the running deck.

In certain embodiments, the accessory can be configured to allow a physically impaired individual to exercise on a treadmill while in a seat position over the running deck of the treadmill.

In certain embodiments, the base can be comprised of a plurality of components that can be releasably fastened together, such as side members each having an end releasably connected to a rear member.

The members of the base can be configured to be connected in a telescoping arrangement using fasteners.

In some embodiments, the fasteners can be spring loaded quick release pins to facilitate rapid and easy assembly and disassembly.

In certain embodiments, the base can be comprised of tubular side members having a plurality of apertures to allow adjustment of the spacing between the side members.

Optionally, the accessory can be provided with a foot plate on each side member of the base to allow a user to rest or exercise one leg only.

Encompassed by this disclosure is a physical therapy apparatus having a treadmill including a running deck, a seat platform extending rearwardly of the running deck, a seat mounted on the seat platform, and a handrail supported above and laterally adjacent each opposite side of the running deck along the length of the running deck.

Also encompassed by this disclosure is a physical therapy apparatus having a treadmill including a running deck and a seat platform positioned over the running deck to allow a user to exercise on the treadmill while seated over the running deck.

DETAILED DESCRIPTION

Figure 1:
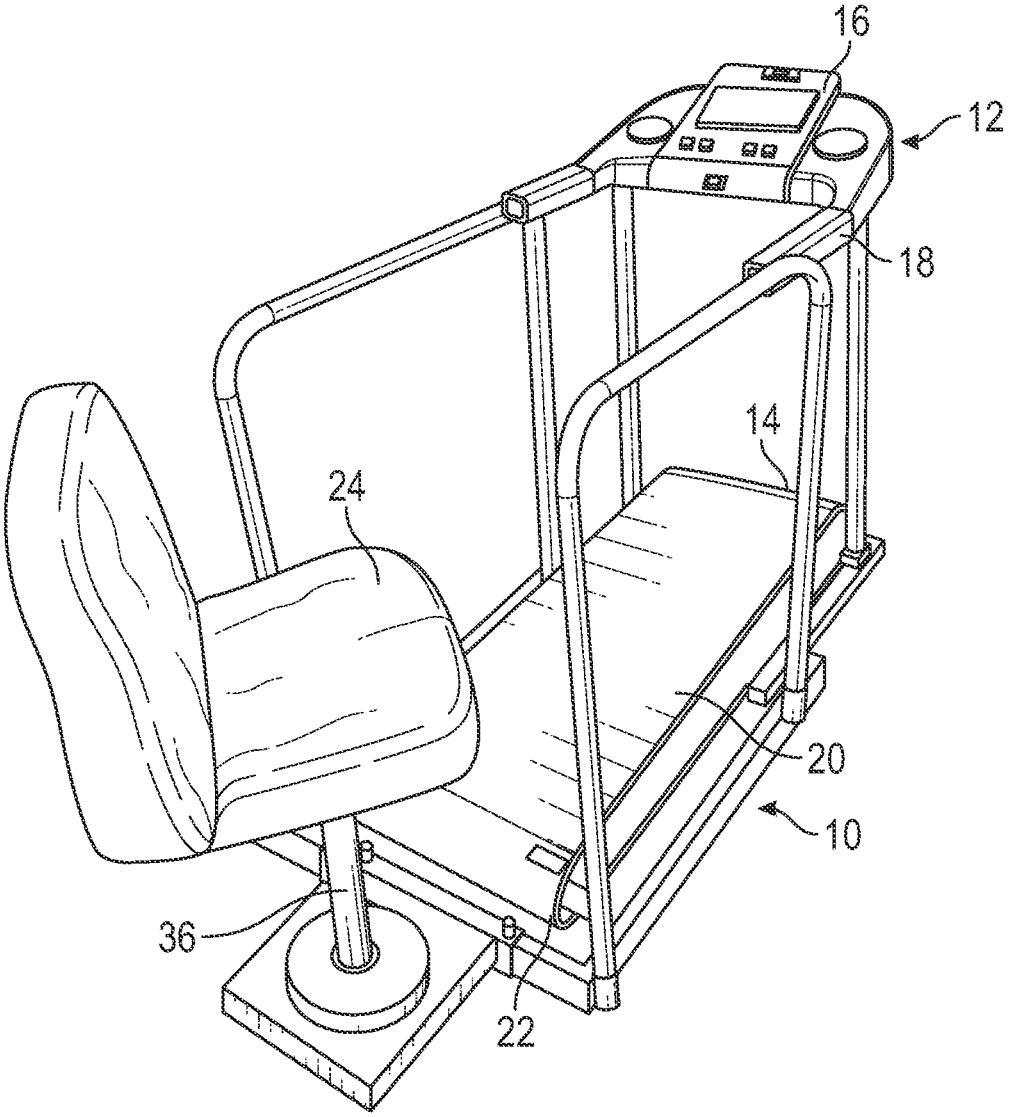
FIG. 1 is a perspective view of a physical therapy accessory being positioned for use with a treadmill
Figure 2:
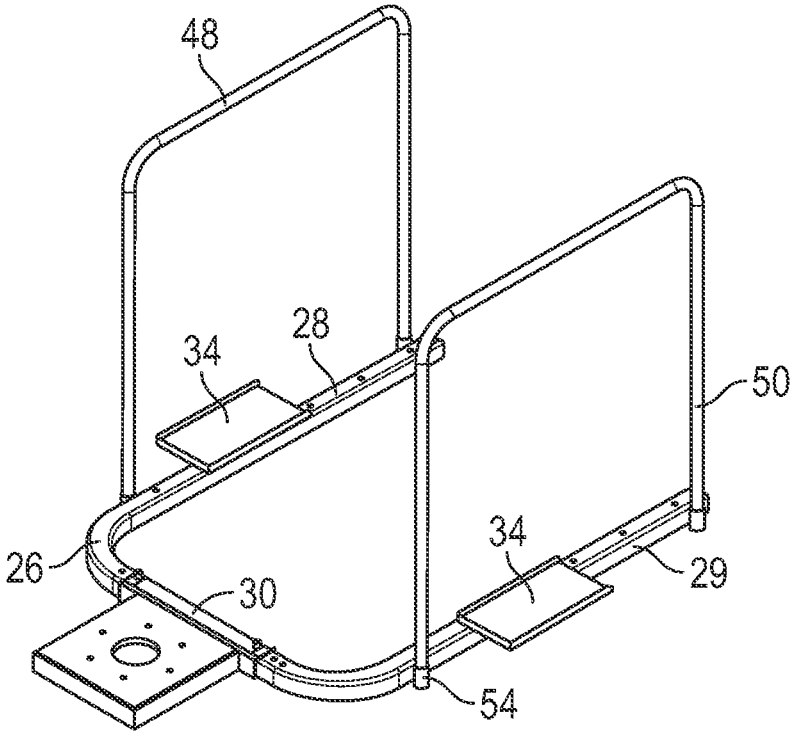
FIG. 2 is a perspective view of the accessory by itself without its seat.
Figure 3:
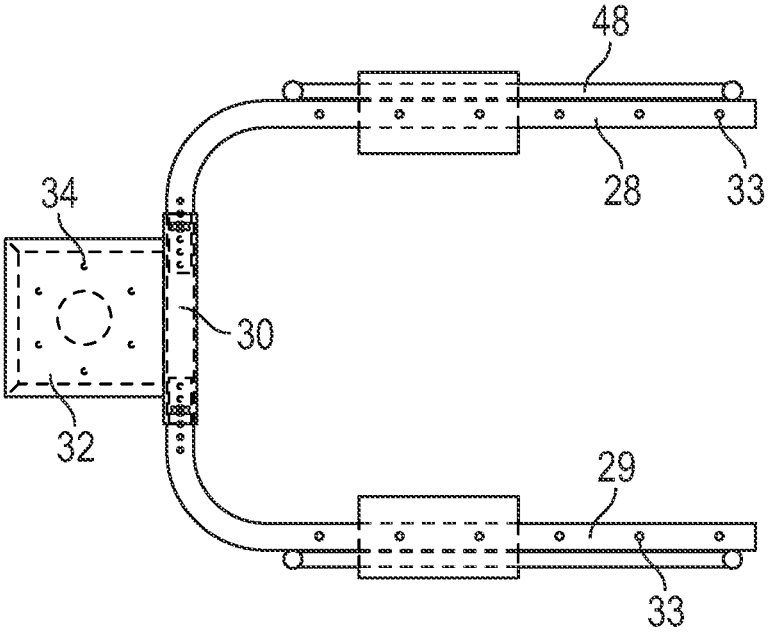
FIG. 3 is a top plan view of the accessory shown in FIG. 2.
Figure 4:
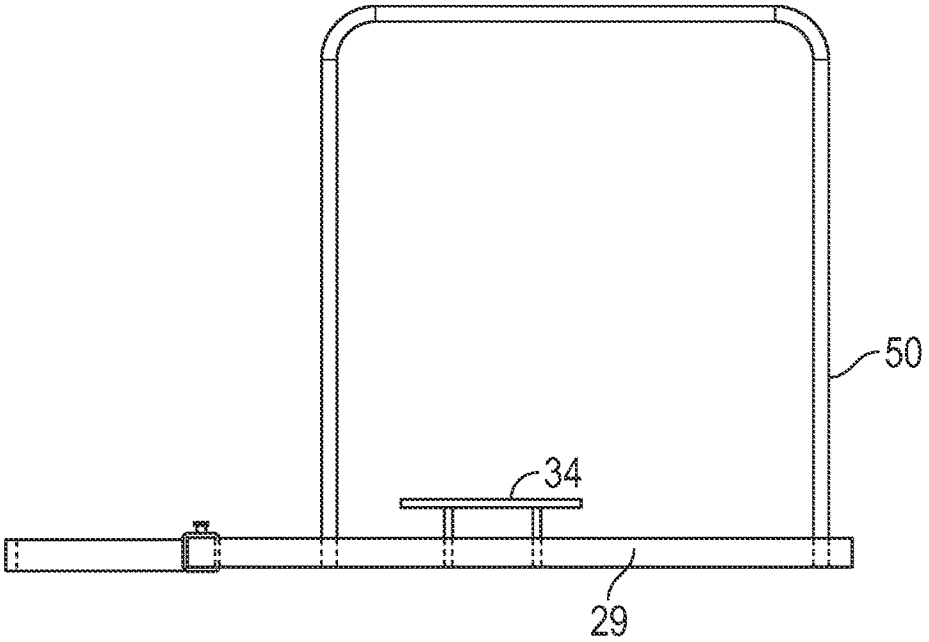
FIG. 4 is a side elevated view of the accessory shown in FIG. 2.
Figure 5:
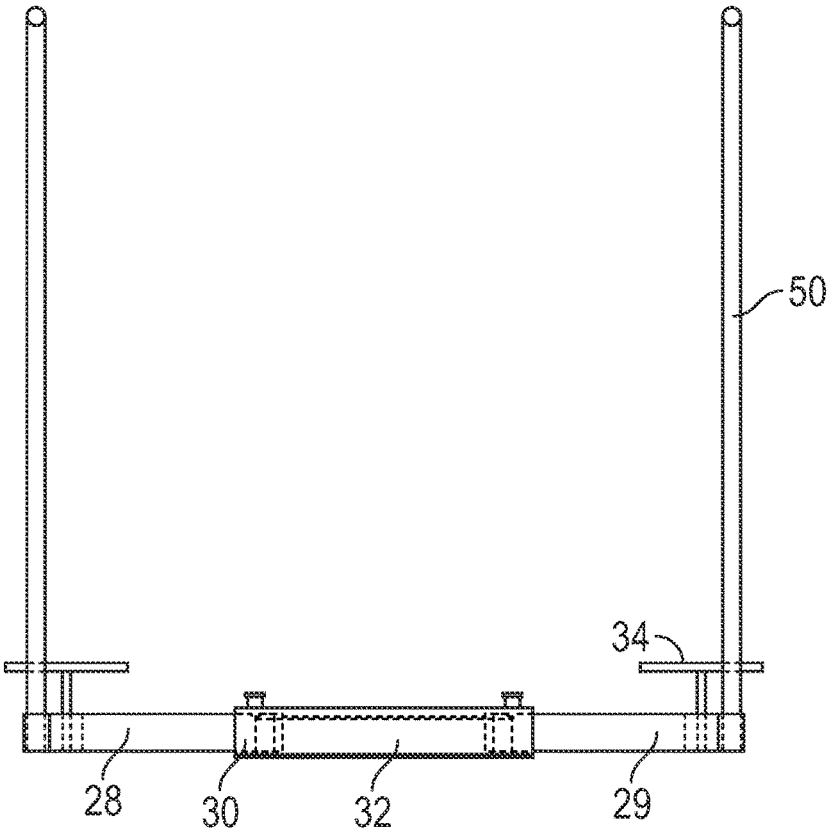
FIG. 5 is a rear elevational view of the accessory shown in FIG. 2.
Figure 7:
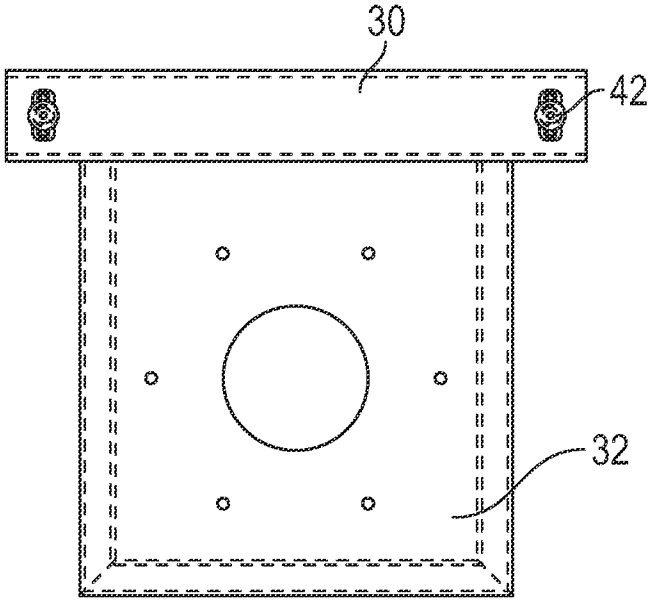
FIG. 7 is a top plan view of the component shown in FIG. 6.
Figure 9:
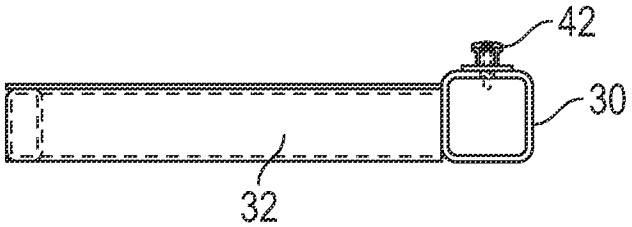
FIG. 9 is a side elevational view of the component shown in FIG. 6.
Figure 6:
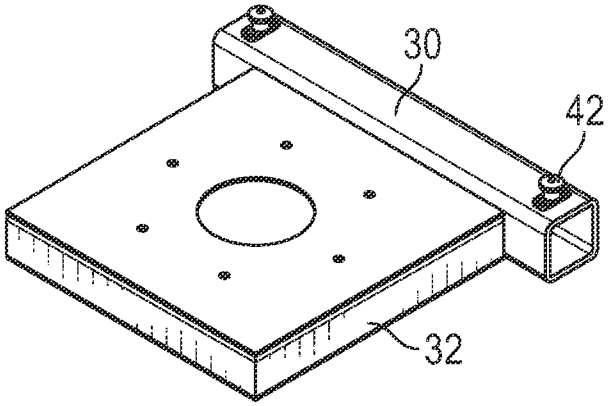
FIG. 6 is a perspective view of a component of the accessory shown in FIG. 2 prior to assembly.
Figure 8:
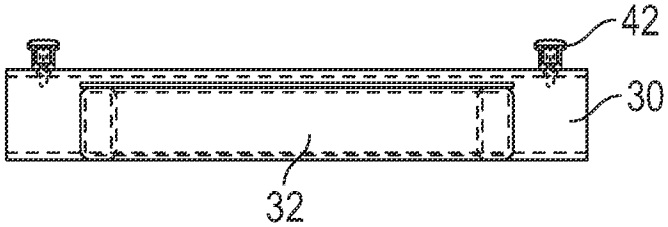
FIG. 8 is a front elevational view of the component shown in FIG. 6.

A physical therapy accessory 10 designed for use with generally any treadmill 12 having a running deck including a moving belt is shown in FIG. 1. Supported above a front end 14 of treadmill 12 is a display console 16 from which relatively short handrails 18 project rearwardly. For those individuals in need of rehabilitating weakened lower body muscles, it is often desirable to step onto the running deck 20 of treadmill 12 from a seated position, preferably from a seat located at a rear end 22 of the running deck. These individuals would benefit from handrails 48 that extend substantially the length of running deck 20 to provide stable support as the user moves from a seated position on seat 24 to a central running or walking position on deck 20. Seat 24 can be a swivel and height adjustable seat to accommodate a user's height and more easily facilitate seating unhindered by the handrails.

The accessory 10 is shown by itself without seat 24 in FIGS. 2-5. Accessory 10 includes a base 26 that has a generally U-shaped form. Base 26 includes two spaced apart side members 28, 29 that are connected with a rear member 30. U-shaped base 26 is sized and shaped to fit closely around opposite sides and the rear 22 of treadmill 12. It is conceivable that base 26 is formed of a unitary structure, such as a tube having a square profile with two bends to define the U-shape. However, it's believed to be more desirable for purposes of shipping and storage to assemble the base from a plurality of components that are releasably connected together, such as with fasteners, to form a rigid U-shaped frame.

Extending rearwardly from rear member 30 is a seat platform 32 having a plurality of apertures 34 for securing a swiveling adjustable height pedestal 36 with chair or seat 24. Platform 32 can be releasably connected to base 26, such as to rear member 30 using fasteners. Alternatively, platform 32 can be permanently attached to member 30, such as by welding.

In the illustrated, and presently preferred embodiment, base 26 is comprised of two identical side member components 28 (shown in FIGS. 10 and 11) to simplify production, inventory management, and packaging of components for shipment. In order to achieve this, apertures 33 for adjustably positioning a foot plate 34 on each member 28 are provided on opposite sides of member 28. Likewise apertures 38 are provided on opposite sides of member 28 to facilitate releasable connection to opposite ends of member 30 using fasteners. Alternatively, apertures 33 and 38 can be provided on only one side of two different components 33 that are mirror images of one another.

As indicated in FIGS. 6-9, member 30 can be a tube having a square profile dimensioned to telescopically receive the square profiled ends 40 of components 28. Fasteners, such as nuts and bolts can be used to releasably attach member 28 to member 30. However, in the illustrated, and preferred embodiment, spring loaded quick release pins 42 are employed to simplify assembly and disassembly of the accessory 10. Members 28 and 30 and seat platform 32 can be made of generally any tough, durable material, with steel and/or aluminum materials being preferred.

Figure 11:
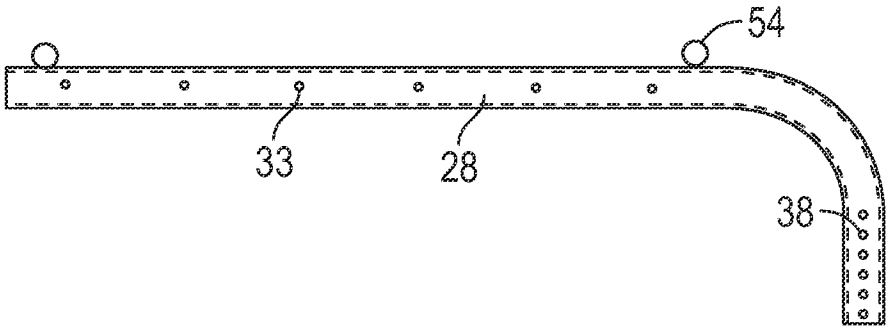
FIG. 11 is a top plan view of the component shown in FIG. 10.
Figure 12:
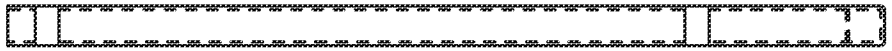
FIG. 12 is a side elevational view of the component shown in FIG. 10.
Figure 10:
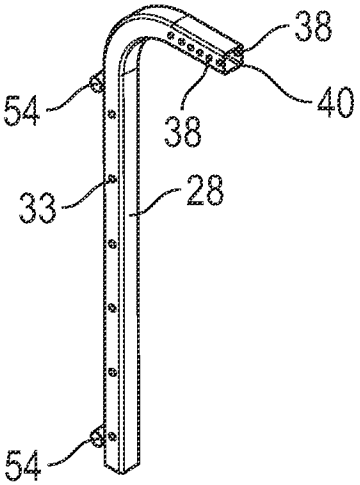
FIG. 10 is a perspective view of another component of the accessory shown in FIG. 2 prior to assembly.

As indicated in FIGS. 10 and 11, members 28 have a plurality of apertures 38 to allow adjustment of the spacing between members 28 to accommodate generally any treadmill, which typically have a thread or running deck width of from about 2 feet to about 3 feet. For example, by providing 6 apertures 38 spaced about one inch apart, ten inches of adjustability are provided (e.g., from about 2 feet, 2 inches to about 3 feet), thus accommodating generally any commercially available treadmill.

Figure 13:
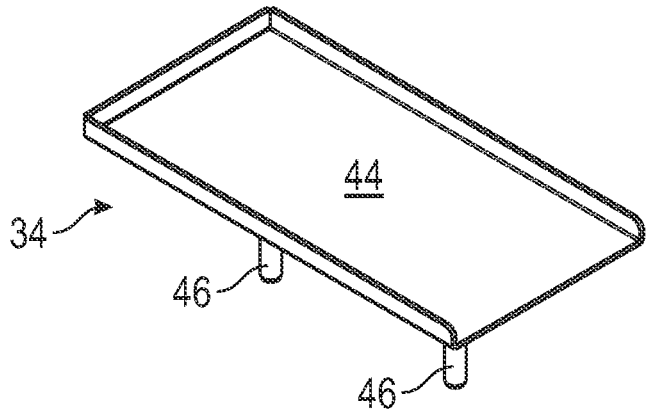
FIG. 13 is a perspective view of a third component of the accessory shown in FIG. 2.
Figure 14:
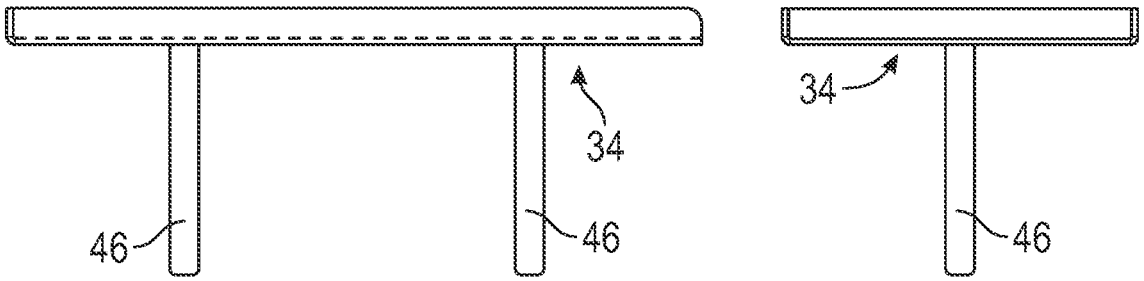
FIG. 14 is a side elevational view of the component shown in FIG. 13.
Figure 15:
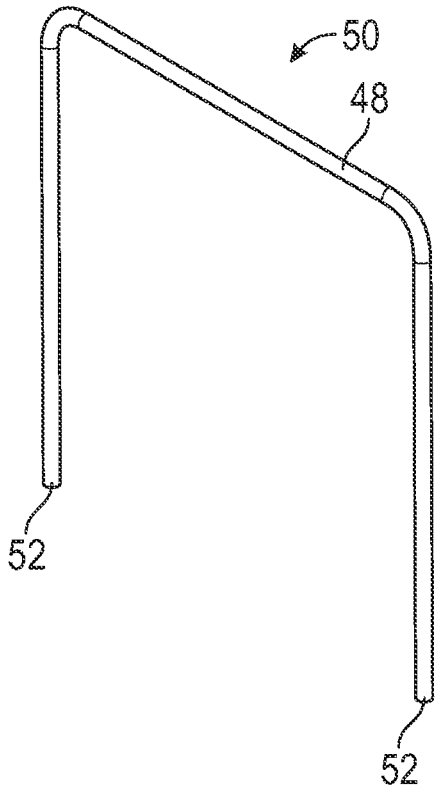
FIG. 15 is a perspective view of a further component of the accessory shown in FIG. 2.

Optional foot plates 34 (shown in FIGS. 1, 13 and 14) can be provided to allow the user to rest while the treadmill is still operating, or a single foot plate could be used to allow a user to exercise muscles of only one leg at a time. Foot plates 34 can have a generally rectangular upper surface 44 for supporting a foot of a user and two downwardly projecting pins configured to be received in adjacent apertures 33 of member 29. In the illustrated embodiment, each member 29 has 6 apertures 33 allowing foot plate 34 to be located in any of 5 different positions along the length of members 29. Foot plates 34 can be made of steel or aluminum, or a tough plastic such as acrylonitrile butadiene styrene (ABS) terpolymer or polyethylene terephthalate glycol (PET-G).

Handrails 48 (shown in FIGS. 1-5 and 15) can be attached to base members 28, 29 by sliding ends 52 of U-shaped handrail assembly 50 into cylindrical receptacles 54, which can be welded or otherwise permanently joined to base members 28. Assembly 50 can be a unitary structure made by bending a tube or rod to create two 90° angles or can be fabricated from tubes and 90° elbows. Assembly 50 can be facilitated from steel, aluminum or a tough plastic, such as ABS or PET-G.

In certain embodiments, the accessory seat and handrails can be integral or integratable components of a physical therapy apparatus. For example, the seat platform could be releasably or permanently affixed directly to a rear end of a base portion of the treadmill support structure, and the handrails could be supported on lateral portions of the treadmill base rather than on a U-shaped base 26 (as previously described).

Figure 16:
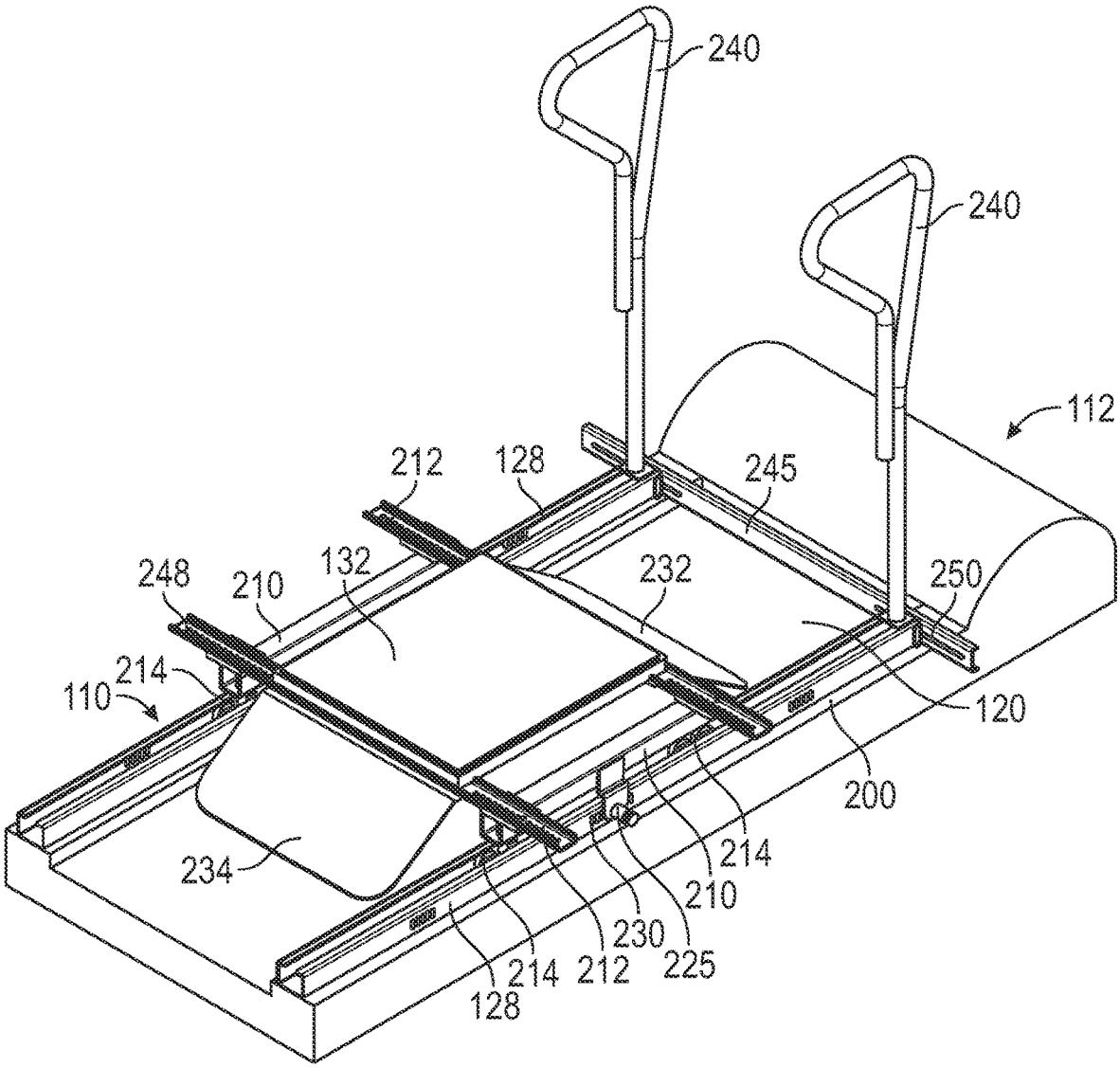
FIG. 16 is a perspective view of an alternative physical therapy treadmill and accessory.

Shown in FIG. 16 is another embodiment in which a seat platform 132 is supported over the running deck 120 of a treadmill 112 to allow a physically impaired individual to exercise their legs while in a seated position over the running deck. In the illustrated embodiment, an accessory 110 is described. However, the various components of accessory 110 can be integrally formed into components of treadmill 112 or permanently integrated into treadmill 112. Accessory 110 includes spaced apart side rails 128 mounted to (such as with bolts, screws or other fasteners) or positioned on portions 200 of treadmill 112 along and outwardly of running deck 120. A seat (not shown in FIG. 16) such as seat 24, is mounted onto platform 132, such as with a pedestal 36, which may be height adjustable and which may allow swiveling of the seat.

Figure 17:
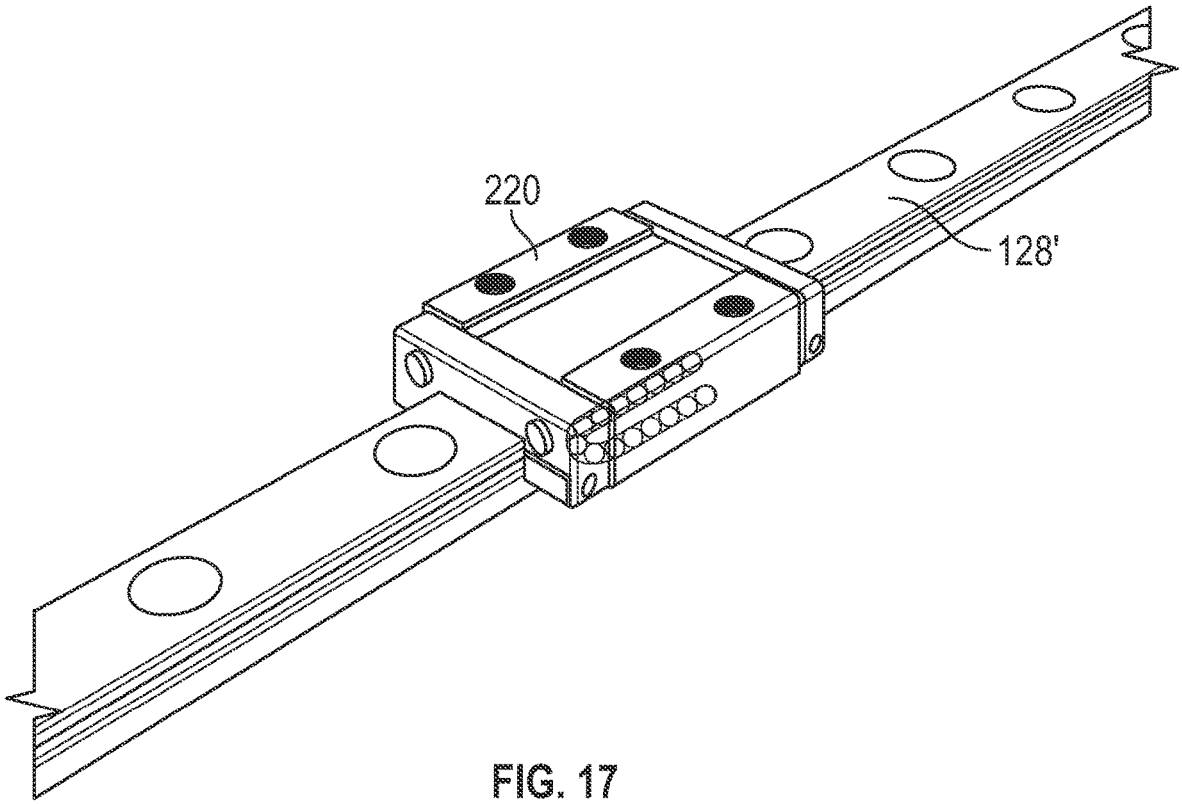
FIG. 17 is a perspective view of a linear guide assembly used with the accessory of FIG. 16.

The position of platform 132 can be adjustable along the length of running deck 120. In the illustrated embodiment, platform 132 is supported on a frame comprising longitudinal members 210 and cross members 212. Roller assemblies 214 are captured and guided by inwardly flanged U-shaped channels defined by side rails 128 to allow linear movement of platform 132 along the length direction of deck 120. As an alternative, linear guide assemblies 220 as shown in FIG. 17 can be used rather than roller assemblies 214 to facilitate positioning of platform 132 along the length direction of deck 120, and guide rails 128' can have a bar profile rather than the inwardly flanged U-shaped channels of side rails 128. A lock assembly 225, such as a spring-loaded pin engageable with any one of a plurality of apertures 230 can be used to hold platform 132 in a desired position along the length of deck 120.

In order to reduce a risk of injury, such as from a foot of the user being caught between platform 132 and deck 120, a downwardly ramped safety panel 232 may extend from a location proximate a forward edge of platform 132. Similarly, a downwardly ramped safety panel 234 may extend from a location proximate a rearward edge of platform 132.

Side rails 128 can be configured to support handles 240.

In order to maintain the proper spacing between side rails 128, such as when side rails 128 are not mechanically fastened to portions 200 of treadmill 112, a cross member 245 may be employed.

Accessory 110 can be used with treadmills having a deck width of various dimensions (e.g., about 2 feet to about 3 feet) such as by providing members 212 with fastener apertures 248 that allow adjustment of the spacing between longitudinal members 210, and by providing cross member 245 with slots 250 to accommodate adjustment of the spacing between side rails 128.

The above description is intended to be illustrative, not restrictive. The scope of the invention should be determined with reference to the appended claims along with the full scope of equivalents. It is anticipated and intended that future developments will occur in the art, and that the disclosed devices, kits and methods will be incorporated into such future embodiments. Thus, the invention is capable of modification and variation and is limited only by the following claims.

The invention claimed is:

1. A physical therapy accessory for use with a treadmill, comprising:

a base having two opposite side members spaced apart to allow positioning of a running deck of the treadmill between the two side members, and a rear member connected to each of the two side members to form a rigid U-shaped frame that extends along and around a rearward portion of the running deck;

a seat platform extending rearwardly of the rear member;

a seat mounted on the seat platform rearwardly of the rear member; and a handrail assembly supported on each side member.

2. The accessory in accordance with claim 1, wherein the rear member comprises a tube affixed to the seat platform, the tube having opposite ends, each end configured for releasable attachment to one of the two side members.

3. The accessory in accordance with claim 2, wherein the tube and the two side members are configured to be connected in a telescoping arrangement using fasteners.

4. The accessory in accordance with claim 3, wherein the fasteners are spring loaded quick release pins.

5. The accessory in accordance with claim 3, wherein an end of each side member connectable to the tube has a plurality of fastener apertures to allow adjustment of a space between the two side members.

6. The accessory in accordance with claim 1, further comprising a foot plate mounted on an upper surface of each side member.

7. A physical therapy accessory for use with a treadmill, comprising:

two opposite side rails spaced apart and configured to allow positioning of the two side rails on portions of the treadmill adjacent to opposite edges of a running deck of the treadmill;

a seat platform assembly supported on the two side rails and over the running deck;

a seat mounted on the seat platform; and a downwardly ramped safety panel extending proximate a forward edge of the seat platform.

8. The accessory of claim 7, further comprising roller assemblies configured for supporting the seat platform assembly and facilitating movement of the seat platform assembly along a length direction of the two side rails.

9. The accessory of claim 8, wherein the two side rails have an inwardly flanged U-shaped channel configuration to capture and guide rollers of the roller assemblies.

10. The accessory of claim 8, further comprising a lock assembly for holding the seat platform at a fixed position along the length direction of the two side rails.

11. The accessory of claim 7, further comprising linear guide assemblies configured for supporting the seat platform assembly and facilitating movement of the seat platform assembly along a length direction of the two side rails.

12. The accessory of claim 11, further comprising a foot plate mounted on an upper surface of each side rail.

13. The accessory of claim 7, further comprising a handle assembly supported on each side rail.

* * * * *